US006135283A

United States Patent [19]

Huang

[11] Patent Number: 6,135,283

[45] Date of Patent: Oct. 24, 2000

[54] ELECTRIC PLUG CARRIER AND LIGHT STRING PACKING ARRANGEMENT

[75] Inventor: Peter K. H. Huang, Taipei, Taiwan

[73] Assignee: Shining Blick Enterprises Co., Ltd., Taipei, Taiwan

[21] Appl. No.: 09/325,843

[22] Filed: Jun. 4, 1999

[30] Foreign Application Priority Data

May 17, 1999 [CN] China ..... 99 2 11049

[51] Int. Cl.[7] ..... B65D 85/42

[52] U.S. Cl. ..... 206/420; 206/419; 206/702

[58] Field of Search ..... 206/419, 420, 206/421, 422, 702; 362/226, 249

[56] References Cited

U.S. PATENT DOCUMENTS

| | | | |
|---|---|---|---|
| 3,243,925 | 4/1966 | Buzzell . | |
| 5,064,067 | 11/1991 | McAllister et al. | 206/420 |
| 5,168,999 | 12/1992 | Lee et al. | 206/420 |
| 5,317,491 | 5/1994 | Lee | 206/421 |
| 5,813,535 | 9/1998 | Tseng | 206/419 |

FOREIGN PATENT DOCUMENTS

| | | |
|---|---|---|
| 295 08 070 U | 9/1995 | Germany . |
| 198143 | 5/1923 | United Kingdom . |

*Primary Examiner*—David T. Fidei
*Attorney, Agent, or Firm*—Dougherty & Troxell

[57] ABSTRACT

An electric plug carrier and light string packing arrangement including a light string packing holding a light string having an electric plug, and an electric plug carrier mounted in the light string packing. The electric plug carrier includes a base plate positioned in the light string packing, a slide holding the electric plug of the light string on the base plate, and a button connected to the slide and driven to move the slide on the base plate between a first position where the electric plug of the light string is received inside the light string packing, and a second position where the electric plug of the light string is extended out of an opening at the light string packing for making a test.

8 Claims, 8 Drawing Sheets

ELECTRIC PLUG CARRIER AND LIGHT STRING PACKING ARRANGEMENT

BACKGROUND OF THE INVENTION

The present invention relates to an electric plug carrier and light string packing means arrangement, in which an electric plug carrier is packed with a light string in a light string packing means, and the electric plug of the light string is allowed to be moved with a slide of the electric plug carrier out of an opening at the light string packing means for making a test.

When a light string is made, it is packed in an individual packing box or the like. If to test the function of the light string, the packing box must be opened, so that the electric plug of the light string can be taken out of the packing box and connected to an electric outlet. It needs much labor when testing a big quantity of individually packed light strings.

SUMMARY OF THE INVENTION

The present invention has been accomplished under the circumstances in view. It is the main object of the present invention to provide an electric plug carrier and light string packing means arrangement which enables the electric plug of the light string to be conveniently moved out of the packing means for making a test without opening the packing means. According to one aspect of the present invention, the electric plug carrier and light string packing means arrangement comprises a light string packing means holding a light string having an electric plug, and an electric plug carrier mounted in the light string packing means. The electric plug carrier comprises a base plate positioned in the light string packing means, a slide holding the electric plug of the light string on the base plate, and button means connected to the slide and driven to move the slide on the base plate between a first position where the electric plug of the light string is received inside the light string packing means, and a second position where the electric plug of the light string is extended out of an opening at the light string packing means for making a test. According to another aspect of the present invention, the base plate comprises a longitudinal sliding slot through which the button means is inserted from a bottom side and connected to said slide. According to still another aspect of the present invention, the base plate comprises two locating rails longitudinally arranged in parallel at a top side wall thereof at two opposite sides of the longitudinal sliding slot, and two stop blocks raised from the top side wall and arranged at two opposite sides of the longitudinal sliding slot and respectively spaced from the locating rails at a distance. The positioning spring means of the slide is a T-shaped spring plate suspended from a bottom side wall of the slide and stopped between the locating rails and said stop blocks when the slide is moved to the first position, or at the locating rails at one end remote from the stop blocks when the slide is moved to the second position.

DETAILED DESCRIPTION OF THE PREFERRED EMBODIMENT

Figure 1:
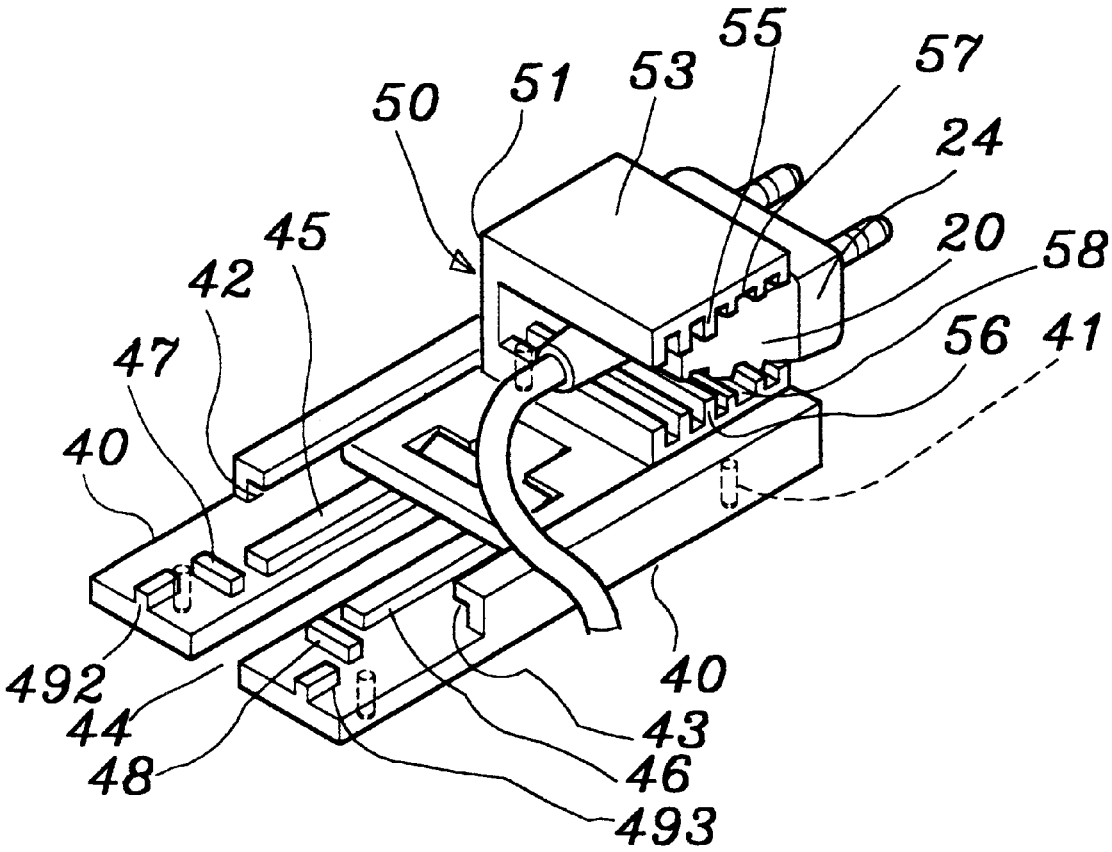
FIG. 1 is a perspective view of an electric plug carrier according to the present invention.
Figure 2:
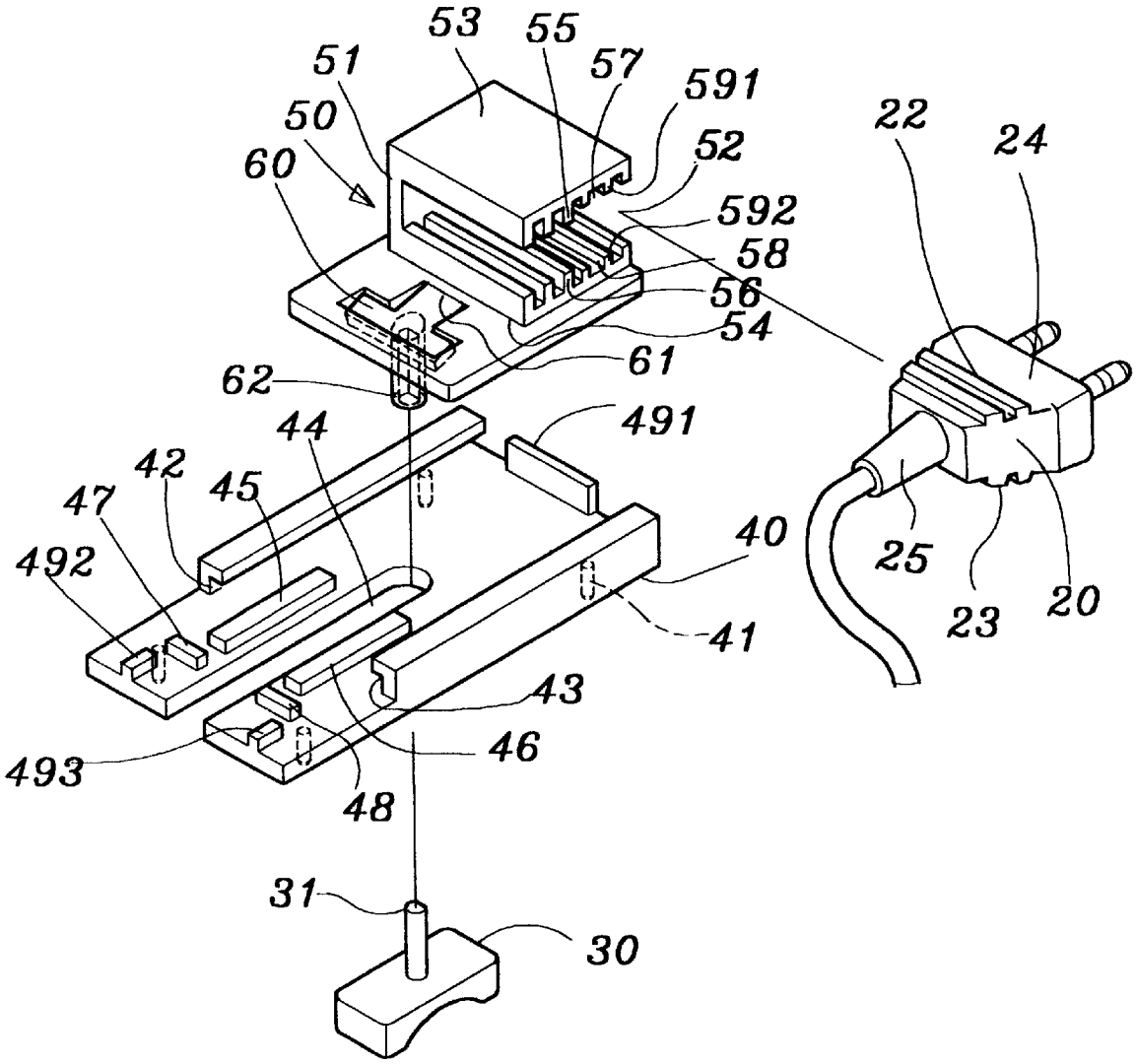
FIG. 2 is an exploded view of the assembly of FIG. 1.
Figure 3:
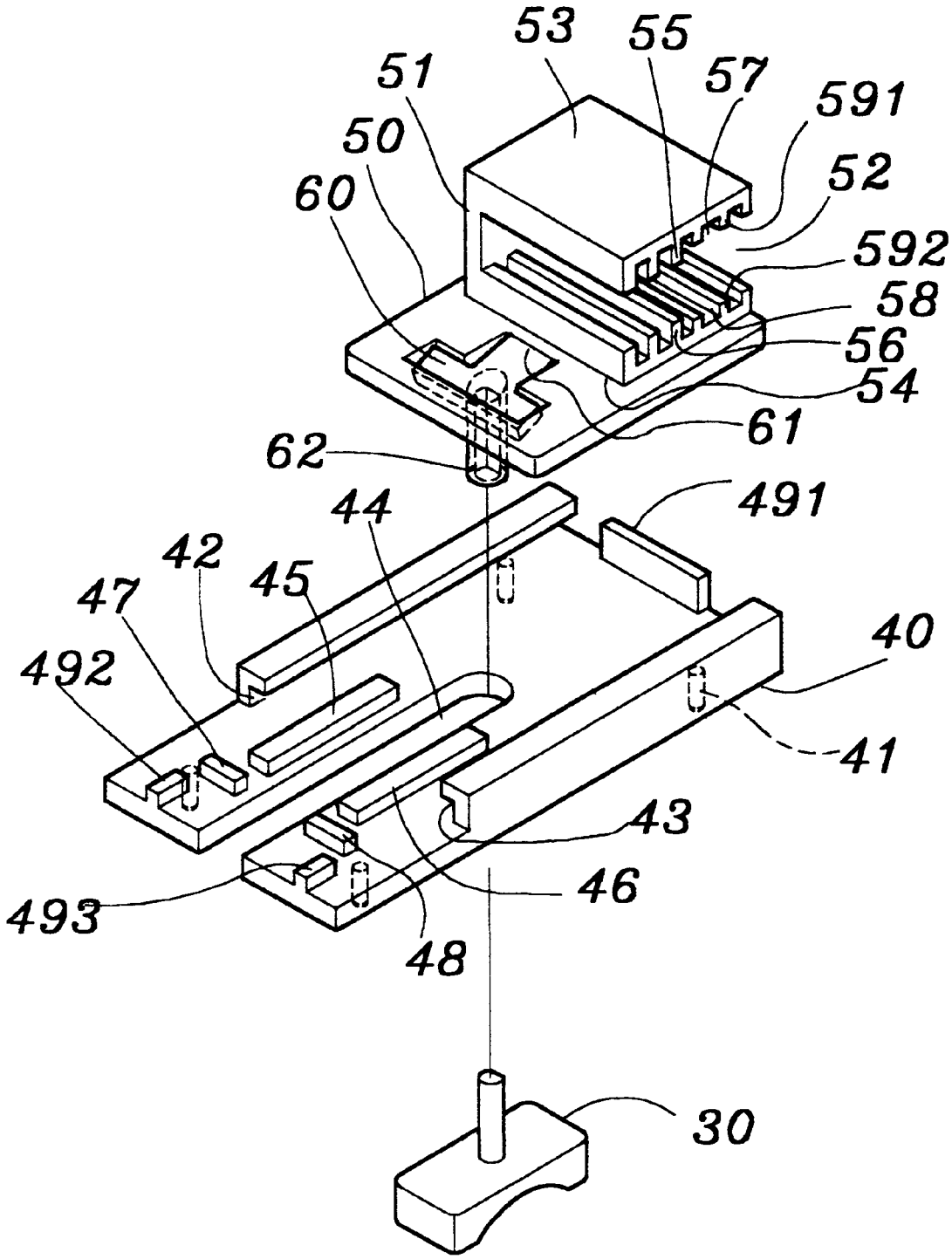
FIG. 3 is an exploded view of the electric plug carrier according to the present invention.

Referring to FIGS. from 1 through 3, an electric plug carrier for a light string is shown comprised of a base plate 40, a slide 50 mounted on the base plate 40 at the top side, and a button 30 mounted on the base plate 40 at the bottom side.

The base plate 40 comprises a plurality of mounting rods 41 raised from the bottom side wall thereof for mounting, two sliding rails 42 and 43 longitudinally arranged in parallel at the top side wall thereof, a sliding slot 44 longitudinally extended to the rear side thereof on the middle, a forward stroke stop plate 491 raised from the top side wall and transversely disposed along the front side thereof between the sliding rails 42 and 43, two backward stroke stop plates 492 and 493 raised from the top side wall and longitudinally extended from the rear side, two locating rails 45 and 46 longitudinally arranged in parallel at the top side wall at two opposite sides of the sliding slot 44, and two stop blocks 47 and 48 raised from the top side wall and arranged at two opposite sides of the sliding slot 44 between the locating rails 45 and 46 and the backward stroke stop plates 492 and 493.

The slide 50 is made to be moved on the base plate 40 between the sliding rails 42 and 43, having a plug holder 51 at the top side wall of the flat bottom plate thereof for holding an electric plug 20. As illustrated, the plug holder 51 has a substantially ⊂-shaped profile. The width of the plug holder 51 is shorter than the flat bottom plate of the slide 50, so that the flat bottom plate of the slide 50 can be coupled to the sliding rails 42 and 43, enabling the plug holder 51 to be moved with the flat bottom plate of the slide 50 between the sliding rails 42 and 43. The plug holder 51 comprises a bottom wall 54 formed integral with the flat bottom plate of the slide 50, a top wall 53 suspended above and arranged in parallel to the bottom wall 54 and defining with the bottom wall 54 a receiving space 52, symmetrical pairs of first locating ribs 55 and 56 respectively provided at the bottom side of the top wall 53 and the top side of the bottom wall 54, symmetrical pairs of second locating ribs 591 and 592 respectively provided at the bottom side of the top wall 53 and the top side of the bottom wall 54 and arranged in parallel to the first locating rib 55 and 56, and pairs of locating grooves 57 and 58 respectively provided at the bottom side of the top wall 53 and the top side of the bottom wall 54 and separated by the second locating ribs 591 and 592. The first locating ribs 55 and 56 have a shorter height than the second locating ribs 591 and 592. The electric plug 20 comprises a housing 24 symmetrical coupling ribs 22 and 23 respectively and transversely raised from the top and bottom side walls of the housing 24, and a jacket 25 formed integral with the back side wall of the housing 24. The housing 24 of the electric plug 20 is inserted into the receiving space 52 between the top wall 53 and bottom wall 54 of the plug holder 51, enabling the coupling ribs 22 and 23 to be respectively engaged into the coupling grooves 57 and 58 in the plug holder 51. After installation of the electric plug 20 in the plug holder 51, the jacket 25 is retained between the first locating rib 55 and 56 in the plug holder 51.

The slide 50 further comprises a T-shaped spring plate 60 obliquely suspended from the flat bottom plate thereof at the bottom side. The T-shaped spring plate 60 has a fixed end 61 formed integral with the flat bottom plate of the slide 50. The other end of the T-shaped spring plate 60 is a free end. A downward coupling tube 62 is provided at the free end of the T-shaped spring plate 60. The aforesaid button 30 has a coupling rod 31 inserted through the sliding slot 44 at the base plate 40 from the bottom side and press-fitted into the downward coupling tube 62.

Figure 4:
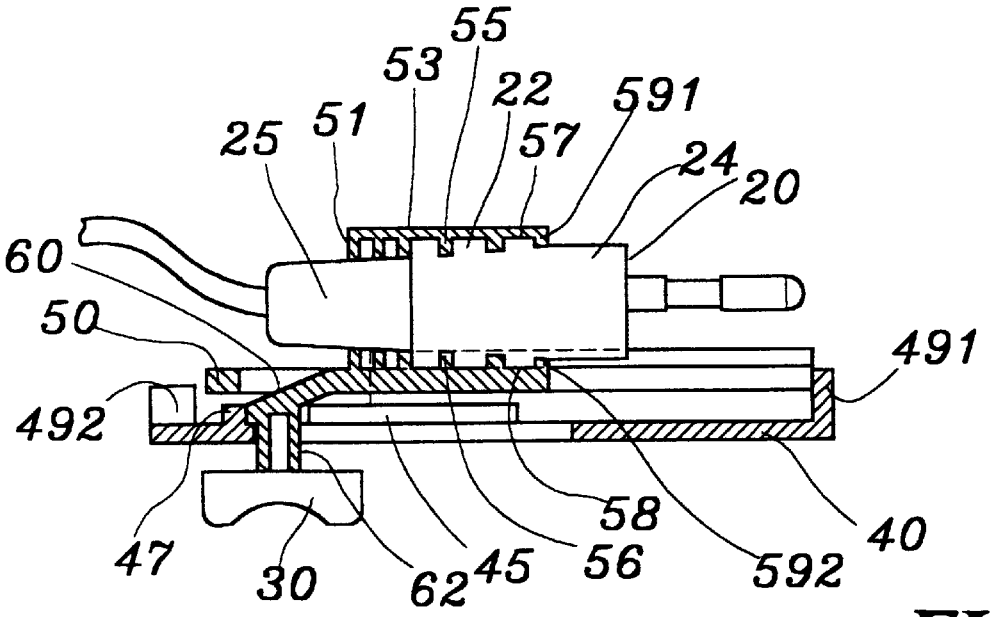
FIG. 4 is a sectional side view of the present invention, showing the slide received in the base plate.
Figure 5:
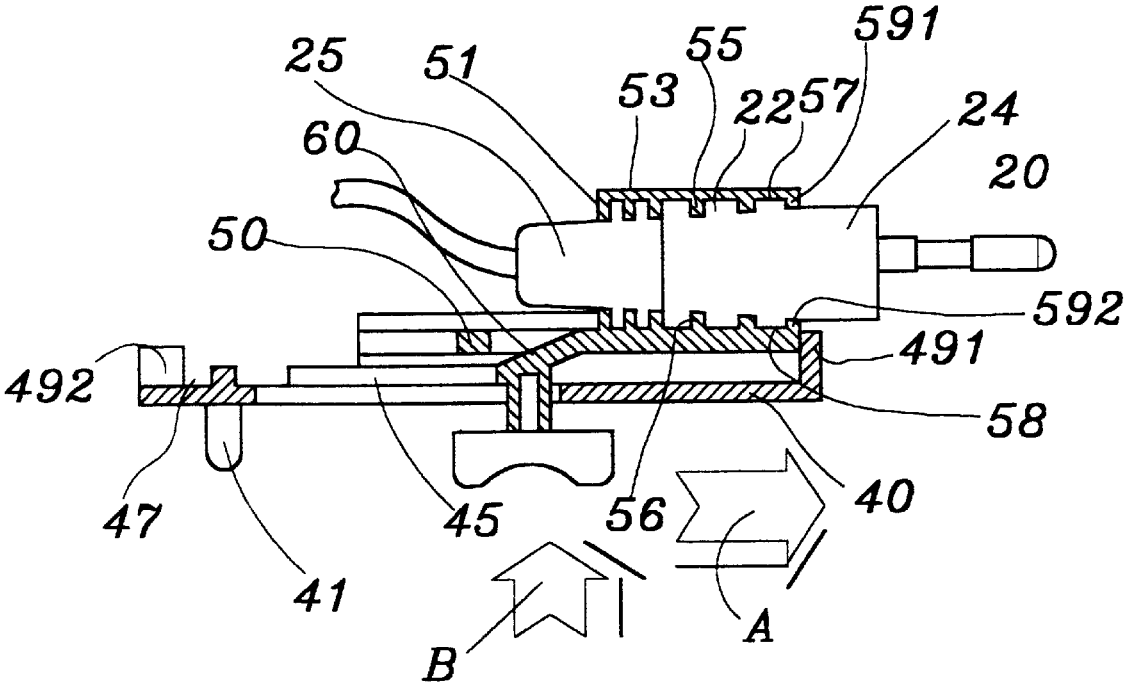
FIG. 5 is similar to FIG. 4 but showing the slide moved forwards, the electric plug extended out of the front side of the base plate.

FIG. 4 shows the electric plug 20 installed in the slide 50, the slide 50 received in the base plate 40, and the T-shaped spring plate 60 retained between the locating rails 45 and 46 and the stop blocks 47 and 48. When pushing the button 30 upwards in direction B and then forwards in direction A, the slide 50 is moved forwards between the sliding rails 42 and 43 to the operative position shown in FIG. 5, where the front side of the slide 50 is stopped at the front stop plate 491, the T-shaped spring plate 60 is stopped against one end of each of the locating rails 45 and 46 remote from the stop blocks 47 and 48, and the electric plug 20 is extended out of the front side of the base plate 40. After test, the button 30 is pushed upwards and then backwards, enabling the slide 50 to be moved back to its former position.

Referring to FIGS. from 6 through 8, the aforesaid electric plug carrier is mounted with a light string in a packing box 10. The packing box 10 is covered with an outer cover 13, having a rectangular bottom wall 18, two opposite long upright side walls 16 and 17 raised from two opposite long sides of the bottom wall 18, two opposite short upright side walls 15 raised from two opposite short sides of the bottom wall 18 and connected between the long upright side walls 16 and 17, and a partition wall 14 connected between the long upright side walls 16 and 17. The partition wall 14 defines with the long upright side walls 16 and 17, the bottom wall 18 and one short upright side wall 15 an electric plug carrier receiving chamber 19. The aforesaid electric plug carrier is received in the electric plug carrier receiving chamber 19. The light string, which is comprised of a set of bulbs 11, a set of lamp sockets 12 and an electric wire 21, is received in the packing box 10. The electric plug 20 of the electric plug carrier is connected to the electric wire 21.

Figure 6:
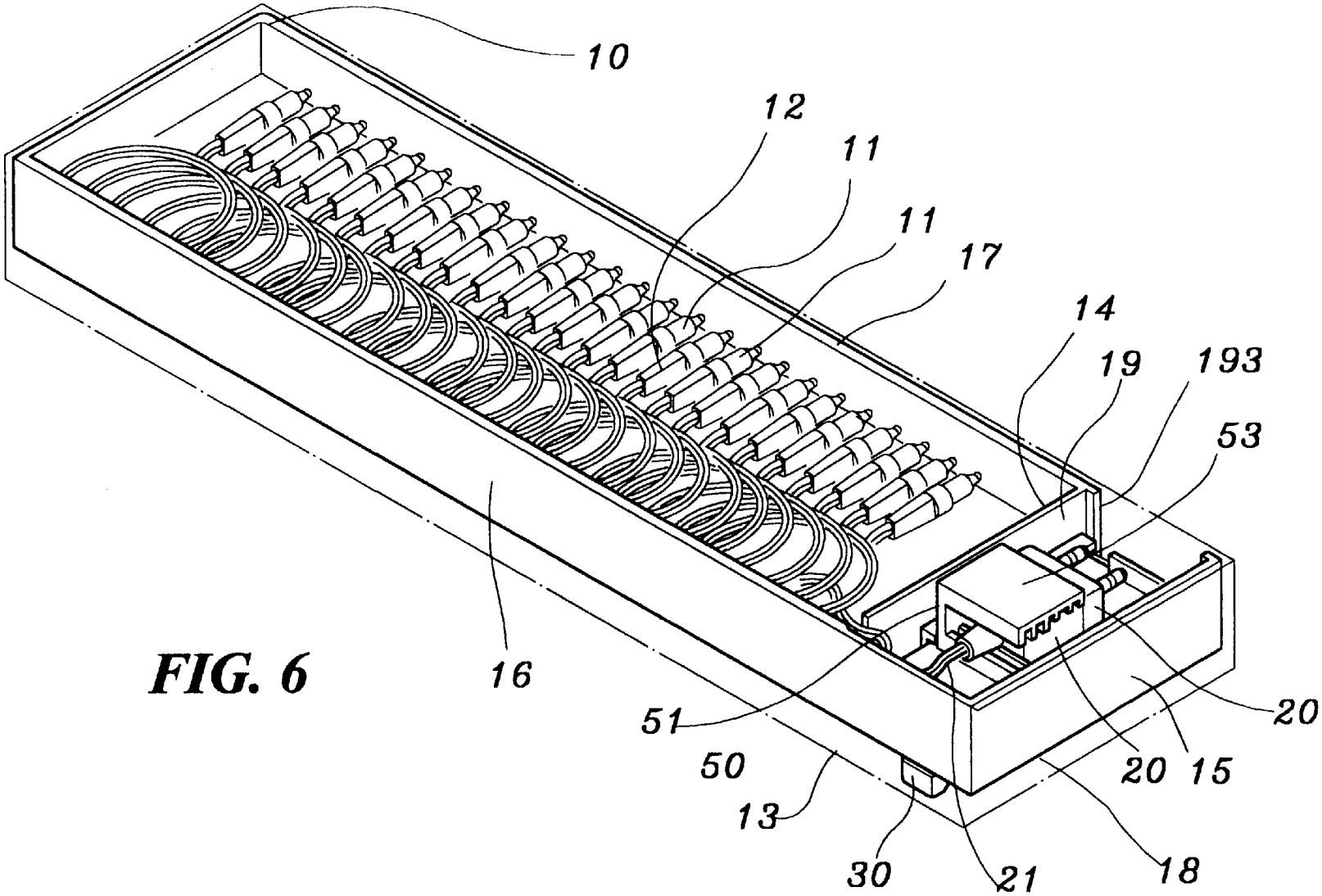
FIG. 6 shows the electric plug carrier mounted with a light string in a light string packing box according to the present invention.
Figure 7:
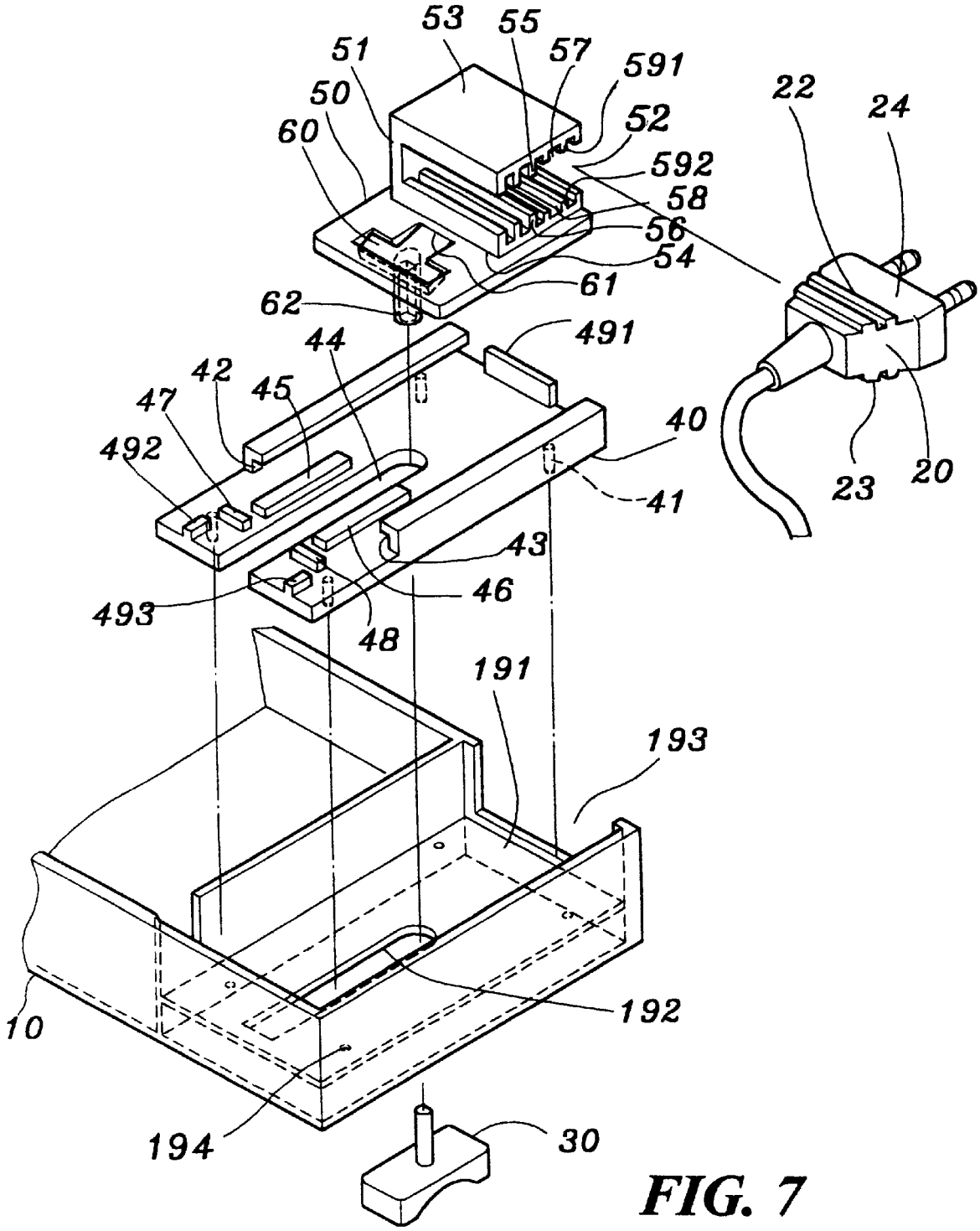
FIG. 7 is an exploded view of a part of FIG. 6.

Referring to FIGS. 6 and 7 again, a bearing plate 191 is provided inside the electric plug carrier receiving chamber 19, and spaced above the bottom wall 18 of the packing box 10 for supporting the electric plug carrier. The bearing plate 191 has a slot 192 corresponding to the sliding slot 44 at the slide 40, and a plurality of mounting holes 194 for the positioning of the mounting rods 41 of the base plate 40. Further, the long upright side wall 17 has an opening 193 corresponding to the electric plug carrier receiving chamber 19. The electric plug 20 to be moved with the slide 50 out of the packing box 10 through the opening 193 for making a test.

Figure 8:
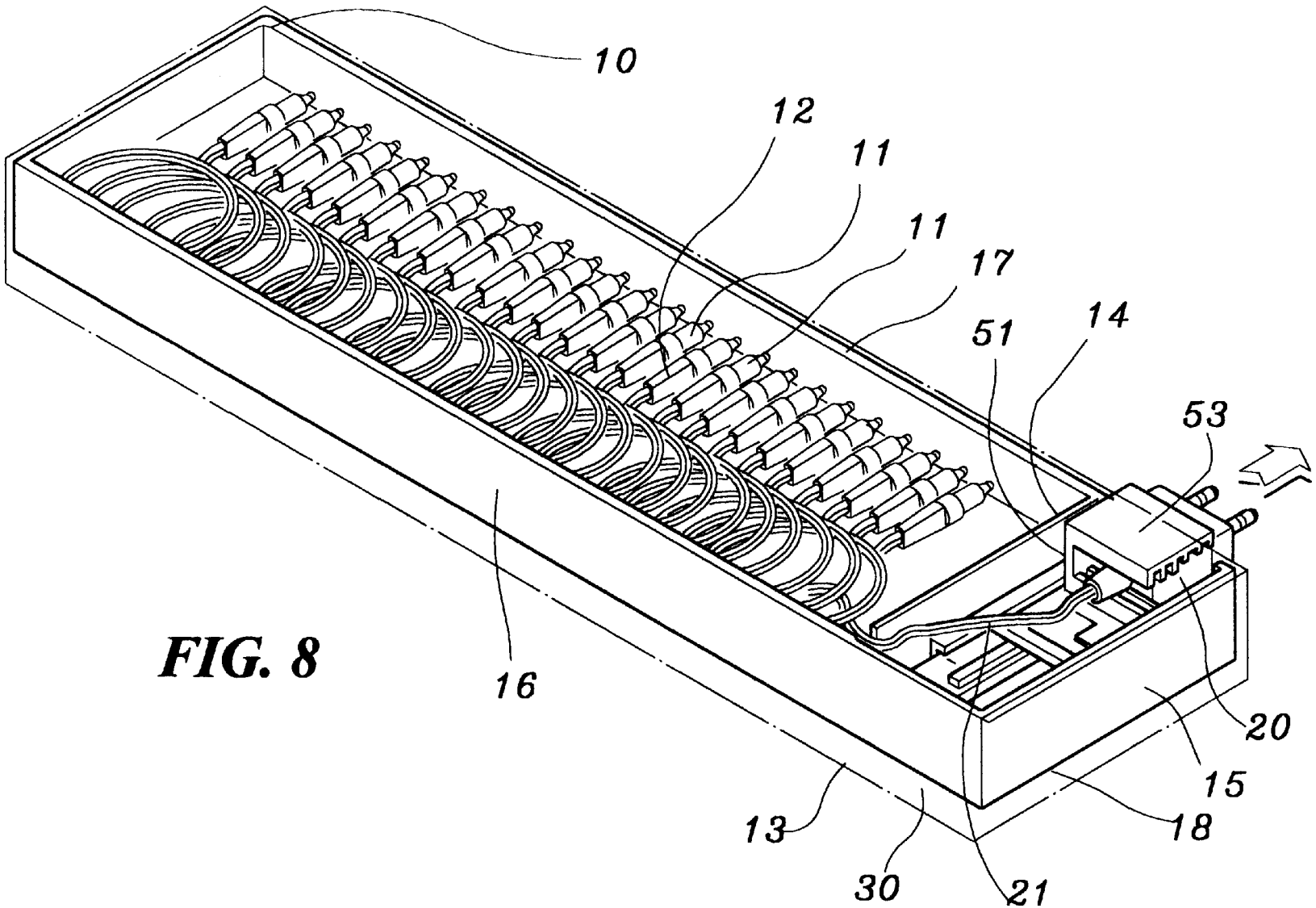
FIG. 8 is similar to FIG. 6 but showing the electric plug extended out of the packing box.

Referring to FIG. 8 and FIG. 6 again, when making a test, the slide 50 is pushed forwards to carry the electric plug 20 out of the packing box 10 through the opining 193 (see FIG. 8). After test, the slide 50 is moved back, enabling the electric plug 20 to be received inside the electric plug carrier receiving chamber 19 (see FIG. 6).

Figures 9, 10:
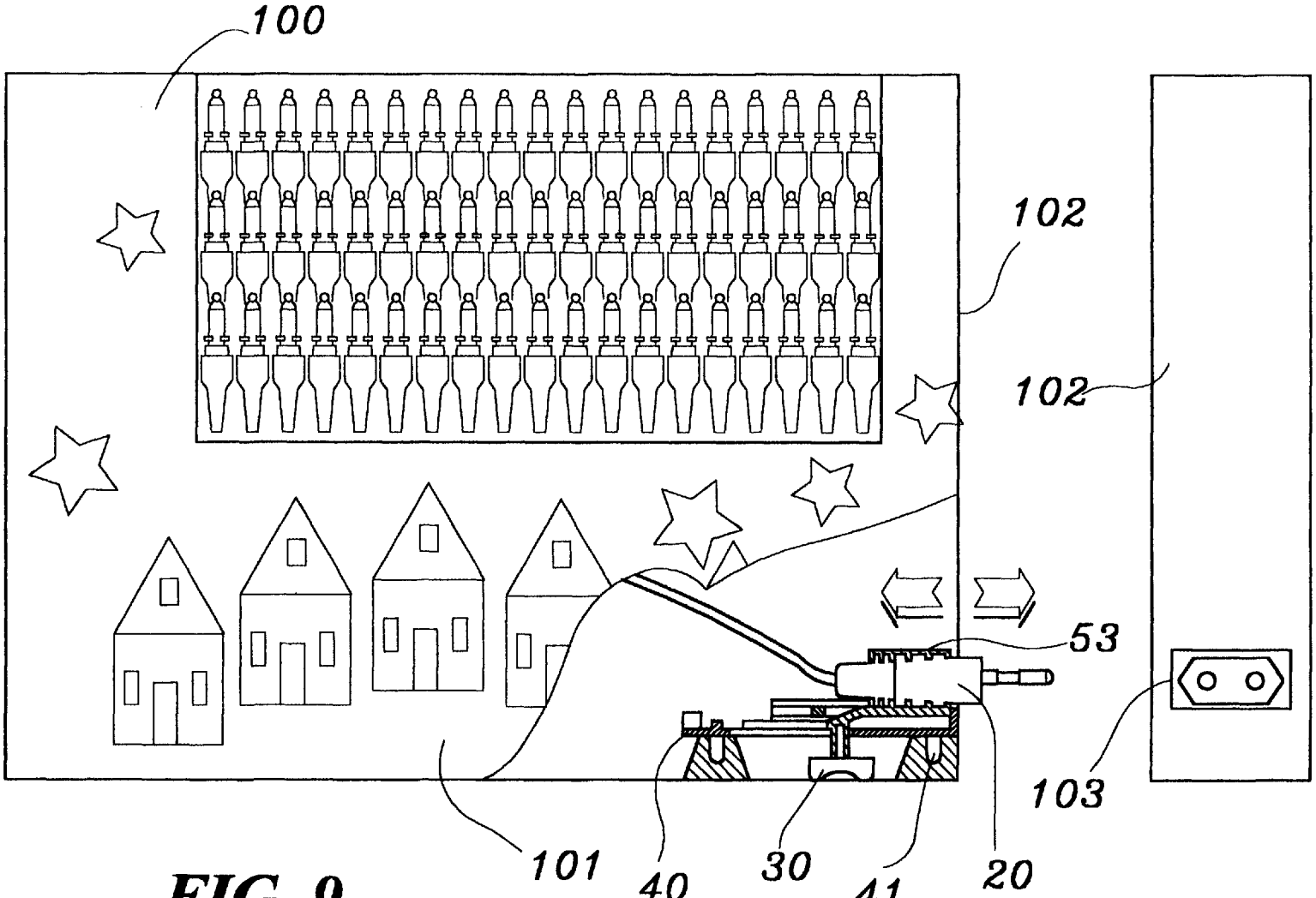
FIG. 9 shows the electric plug carrier mounted with a light string in a light string packing bag according to the present invention.
FIG. 10 is a side view of FIG. 9.

Referring to FIGS. 9 and 10, the aforesaid electric plug carrier can be packed with a light string in a packing bag 100. In this case, the base plate 40 is positioned in a packing bag 100 in one corner, enabling the button 30 to be supported on the bottom side 101 of the packing bag 100 and the electric plug 20 aimed at an opening 103 at one side panel 102 of the packing bag 100. When the electric plug 20 is pushed out of the packing bag 100 through the opening 103, the electric plug 20 can then be connected to an electric outlet to test the function of the light string in the packing bag 100.

It is to be understood that the drawings are designed for purposes of illustration only, and are not intended for use as a definition of the limits and scope of the invention disclosed.

What is claimed is:

1. An electric plug carrier and light string packing arrangement comprising a light string packing holding a light string having an electric plug, and an electric plug carrier mounted in said light string packing, said electric plug carrier comprising a base plate positioned in the light string packing, a slide holding the electric plug of the light string on said base plate, said slide having a positioning spring device for positioning on said base plate, and a button connected to said slide to move said slide on said base plate between a first position where the electric plug of the light string is received inside the light string packing, and a second position where the electric plug of the light string is extended out of an opening at the light string packing for making a test.

2. The electric plug carrier and light string packing arrangement of claim 1 wherein said base plate comprises a longitudinal sliding slot through which said button is inserted from a bottom side and connected to said slide.

3. The electric plug carrier and light string packing arrangement of claim 2 wherein said base plate comprises two locating rails longitudinally arranged in parallel at a top side wall thereof at two opposite sides of said longitudinal sliding slot, and two stop blocks raised from the top side wall and arranged at two opposite sides of said longitudinal sliding slot and respectively spaced from said locating rails; said positioning spring device of said slide is a T-shaped spring plate suspended from a bottom side wall of said slide and stopped between said locating rails and said stop blocks when said slide is moved to said first position, and at said locating rails at one end remote from said stop blocks when said slide is moved to said second position, said spring plate comprises a coupling tube downwardly extending from a free end thereof and coupled to said button.

4. The electric plug carrier and light string packing arrangement of claim 1 wherein said slide comprises an electric plug holder for holding the electric plug of the light string.

5. The electric plug carrier and light string packing arrangement of claim 4 wherein said electric plug holder comprises a bottom wall formed integral with said slide, a top wall suspended above and arranged in parallel to said bottom wall and defining with said bottom wall a receiving space for holding the electric plug of the light string, and symmetrical ribs of different height respectively extending from said bottom wall and said top wall on an inside for securing the electric plug of the light string in said receiving space.

6. The electric plug carrier and light string packing arrangement of claim 1 wherein said light string packing comprises a partition chamber, which receives said electric plug carrier.

7. The electric plug carrier and light string packing arrangement of claim 6 wherein said partition chamber comprises a horizontal bottom bearing plate spaced above a bottom side wall of said light string packing for holding said slide for enabling said button to be suspended in space defined between said horizontal bottom bearing plate and the bottom side wall of said light string packing.

8. The electric plug carrier and light string packing arrangement of claim 1 wherein said light string packing comprises a packing bag having an opening at one peripheral panel thereof, and said electric plug carrier is positioned in one corner in said packing bag, enabling said button to be aimed at a bottom side of said packing bag and the electric plug of the light string to be aimed at the opening at the peripheral panel of said packing bag.

* * * * *